US011092912B2

(12) United States Patent
Aono et al.

(10) Patent No.: US 11,092,912 B2
(45) Date of Patent: Aug. 17, 2021

(54) IMAGE FORMING APPARATUS

(71) Applicant: CANON KABUSHIKI KAISHA, Tokyo (JP)

(72) Inventors: Kazuhiko Aono, Numazu (JP); Seiji Inada, Numazu (JP); Kazushi Suzuki, Suntou-gun (JP); Atsushi Kimura, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/827,996

(22) Filed: Mar. 24, 2020

(65) Prior Publication Data

US 2020/0326644 A1 Oct. 15, 2020

(30) Foreign Application Priority Data

Apr. 10, 2019 (JP) ..... JP2019-074799

(51) Int. Cl.

| | |
|---|---|
| ***G03G 15/16*** | (2006.01) |
| ***G03G 15/01*** | (2006.01) |
| ***B65H 5/06*** | (2006.01) |

(52) U.S. Cl.

CPC ..... *G03G 15/161* (2013.01); *B65H 5/06* (2013.01); *G03G 15/0105* (2013.01); *G03G 15/162* (2013.01); *G03G 2221/0005* (2013.01); *G03G 2221/1606* (2013.01)

(58) Field of Classification Search

CPC ..... G03G 21/206; G03G 15/161; G03G 2221/1645; G03G 15/2028; G03G 21/20; G03G 21/0052

See application file for complete search history.

(56) References Cited

U.S. PATENT DOCUMENTS

| | | | | |
|---|---|---|---|---|
| 7,747,186 | B2 | 6/2010 | Miyamoto et al. | |
| 7,953,343 | B2 * | 5/2011 | Kawamata | G03G 21/206 399/92 |
| 2014/0314437 | A1 * | 10/2014 | Nishida | G03G 21/206 399/92 |
| 2016/0274537 | A1 * | 9/2016 | Yamashita | G03G 21/206 |
| 2018/0011441 | A1 * | 1/2018 | Ueno | G03G 21/206 |

FOREIGN PATENT DOCUMENTS

| | | | |
|---|---|---|---|
| JP | 2007-240703 | A | 9/2007 |

* cited by examiner

*Primary Examiner* — Walter L Lindsay, Jr.
*Assistant Examiner* — Jessica L Eley
(74) *Attorney, Agent, or Firm* — Venable LLP

(57) ABSTRACT

An image forming apparatus includes a photosensitive member, an intermediary transfer member, a transfer portion, a cleaning portion, and an air blowing portion. The air blowing portion blows the air toward an outer peripheral surface of the intermediary transfer member in a moving direction of the intermediary transfer member away from the transfer portion, at a position between the transfer portion and the cleaning portion with respect to a movement direction of the intermediary transfer member.

11 Claims, 6 Drawing Sheets

IMAGE FORMING APPARATUS

FIELD OF THE INVENTION AND RELATED ART

The present invention relates to an image forming apparatus, of an electrophotographic type, such as a copying machine or a laser beam printer.

As an image forming operation of the image forming apparatus using toner, the following operation has been known in general. First, a photosensitive member electrically charged uniformly by a charging means is exposed to light on the basis of image information by an exposure means, so that an electrostatic latent image is formed and then is developed into a toner image by a developing means. The toner image formed on the photosensitive member is transferred onto a recording material by a transfer means and then is heated and pressed by a fixing means, so that the toner image is fixed on the recording material. Further, in a color image forming apparatus, toner images of respective colors are formed on a plurality of photosensitive members and are primary-transferred superposedly on an intermediary transfer member, and thereafter, the toner images, primary-transferred on the intermediary transfer member, are collectively secondary-transferred onto the recording material. Such a method is employed. Here, the photosensitive member and the intermediary transfer member are image bearing members having a function of temporarily holding unfixed toner images. Further, the photosensitive member and the developing means are integrally assembled into a cartridge in many cases for facilitating toner supply and exchange of component parts. Similarly, in many cases, the intermediary transfer member and primary transfer means are integrally assembled into a transfer unit.

The toner image formed on the photosensitive member and the intermediary transfer member is not transferred completely (100%) by the transfer means, but some toner remains on the photosensitive member and the intermediary transfer member after the transfer (hereinafter, this toner is referred to as transfer residual toner) in some instances. Such transfer residual toner is scraped off and collected by a cleaning means contacted to the rotating photosensitive member or the rotating intermediary transfer member. Thus, the cleaning means contacts the photosensitive member or the intermediary transfer member, and therefore, frictional heat generates at a contact portion therebetween. For that reason, the intermediary transfer member is subjected to the frictional heat of the contact portion on the intermediary transfer member and of the contact portion on the photosensitive member, so that a temperature thereof is increased.

A cleaning means for the intermediary transfer member is needed so as not to have the influence on the toner image formed on the intermediary transfer member by expansion or contraction of the intermediary transfer member due to the frictional heat. Further, a portion where the frictional heat generates is an area where the toner exists, so that there is a need to cool this area in order to prevent that the toner is influenced by the heat in this area.

Therefore, a cooling structure by an air blowing means such as a fan blowing (sending) air toward the intermediary transfer member has been known (Japanese Laid-Open Patent Application (JP-A) 2007-240703). In this structure, a cooling mechanism for cooling the intermediary transfer member by blowing the air toward an opposite direction to a movement direction of the intermediary transfer member along the surface of the intermediary transfer member is provided.

However, in this structure, along the surface of the intermediary transfer member, the air blows toward the opposite direction to the movement direction of the intermediary transfer member, and therefore, there is a liability that transfer residual toner is scraped off of the surface of the intermediary transfer member by the flowing (blowing) air and thus is scattered in the image forming apparatus.

Further, the air blowing along the surface of the intermediary transfer member toward the opposite direction to the movement direction of the intermediary transfer member flows toward a fixing device and a feeding passage for guiding a recording material. For that reason, there is a liability that the air which cooled the intermediary transfer member flows into the fixing device and causes improper fixing and that the air flows into the recording material feeding passage and has the influence on an attitude of the recording material.

On the other hand, JP-A 2007-240703 discloses a structure such that a heat-insulating duct member is provided between the fixing device and the intermediary transfer member and the air blown along the surface of the intermediary transfer member is discharged, by using a downstream fan, through the heat-insulating duct member before reaching the fixing device. In this case, although the above-described influence by the air which cooled the intermediary transfer member can be suppressed, arrangement of the heat-insulating duct member is needed, and therefore, there is liability of oppression of a space in the image forming apparatus and an increase in cost.

SUMMARY OF THE INVENTION

A principal object of the present invention is to provide an image forming apparatus capable of suppressing an influence of air cooling an intermediary transfer member on an inside of the image forming apparatus while cooling the intermediary transfer member with a simple structure.

According to an aspect of the present invention, an image forming apparatus includes a photosensitive member; an intermediary transfer member which is supported by a plurality of rollers and onto which a toner image formed on the photosensitive member is transferred in contact with the photosensitive member; a transfer portion configured to transfer the toner image from the intermediary transfer member onto a recording material in contact with the intermediary transfer member; a cleaning portion configured to remove toner remaining from the intermediary transfer member in contact with the intermediary transfer member after the transfer onto the recording material; and an air blowing portion configured to blow air, wherein the air blowing portion blows the air toward an outer peripheral surface of the intermediary transfer member in a moving direction of the intermediary transfer member away from the transfer portion, at a position between the transfer portion and the cleaning portion in a movement direction of the intermediary transfer member.

Further features of the present invention will become apparent from the following description of exemplary embodiments with reference to the attached drawings.

DESCRIPTION OF EMBODIMENTS

Embodiments of the present invention will be specifically described with reference to the drawings. Dimensions, materials, shapes and relative arrangement of constituent elements described in the following embodiments should be appropriately changed depending on structures and various conditions of apparatuses to which the present invention is applied, and the scope of the present invention is not intended to be limited thereto.

(Image Forming Apparatus)

Figure 1:
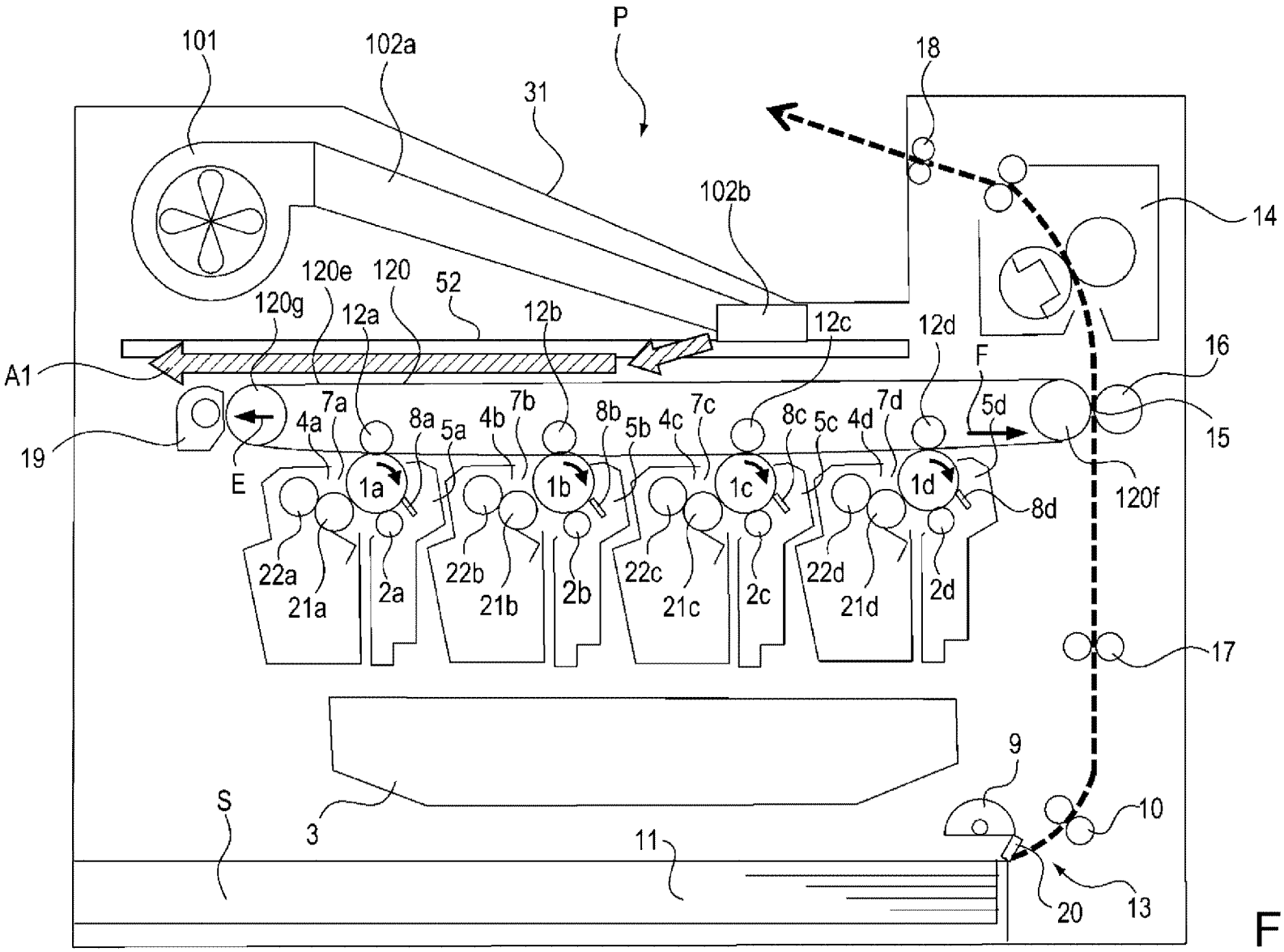
FIG. 1 is a principal sectional view of an image forming apparatus P according to a first embodiment.

With reference to FIG. 1, a general structure of an image forming apparatus according to an embodiment will be described. FIG. 1 is a principal sectional view showing a general structure of an image forming apparatus P. In FIG. 1, a rear side plate 51 is not illustrated for simplification. As the image forming apparatus P, a color laser printer is shown.

The image forming apparatus P includes a plurality of photosensitive members. Here, as shown in FIG. 1, the image forming apparatus P includes four photosensitive drums (1*a*, 1*b*, 1*c*, 1*d*) as the plurality of photosensitive members. Around the respective photosensitive drums 1, along a rotational direction, charging portions 2 (2*a*, 2*b*, 2*c*, 2*d*), a laser scanner 3 as an optical unit, developing units 4 (4*a*, 4*b*, 4*c*, 4*d*) as developing portions, primary transfer rollers 12 (12*a*, 12*b*, 12*c*, 12*d*) and cleaning blades 8 (8*a*, 8*b*, 8*c*, 8*d*) as cleaning portions are provided.

Here, each of the photosensitive drums 1 and process means actable on the associated photosensitive drum 1 are assembled integrally into a process cartridge. Further, the respective process cartridges 7 (7*a*, 7*b*, 7*c*, 7*d*) integrally include, as the process means actable on the photosensitive drums 1, the charging portions 2, the developing units (developing portions) 4 and the cleaning blades 8. The process cartridges 7 (7*a* to 7*d*) are constituted so as to be mountable in and dismountable from the image forming apparatus P.

These four process cartridges 7*a*, 7*b*, 7*c* and 7*d* have the same structure but are different from each other in that toners of different colors of yellow (Y), magenta (M), cyan (C) and black (Bk) are used for image formation. In the following, as regards a structure common to the respective colors, for example, the process cartridges 7*a*, 7*b*, 7*c* and 7*d* are collectively called the process cartridge 7 in a sense of expression of each of the process cartridges 7*a*, 7*b*, 7*c* and 7*d*.

Each of the process cartridges 7 is constituted by the developing unit 4 and a cleaner unit 5. The developing unit 4 includes a developing roller 21, a developer application roller 22 and a toner container. On the other hand, the cleaner unit 5 includes the photosensitive drum 1 as an image bearing member (photosensitive member), the charging portion 2 and the cleaning blade 8.

Opposite end portions of the photosensitive drum 1 as the image bearing member are rotatably supported by the cleaner unit 5 by flanges, and to one opposite end portion, a driving force is transmitted from an unshown driving motor, whereby the photosensitive drum 1 is rotationally driven in the clockwise direction indicated by an arrow in FIG. 1.

The charging portion 2 is an electroconductive roller formed in a roller shape, and not only this roller is contacted to the surface of the photosensitive drum 1 but also a charging bias voltage is applied to the charging portion 2 by an unshown voltage source, whereby the surface of the photosensitive drum 1 is electrically charged uniformly.

The laser scanner 3 is provided below the process cartridge 7 with respect to a vertical direction, and the photosensitive drum 1 is irradiated with light on the basis of an image signal by the laser scanner 3.

The developing units 4*a*, 4*b*, 4*c* and 4*d* include toner accommodating portions accommodating the toners of colors of yellow (Y), magenta (M), cyan (C) and black (Bk), respectively. Further, each of the developing units 4 is adjacent to the surface of the associated photosensitive drum 1 and is rotationally driven by an unshown driving portion, and includes the developing roller 21 for performing development by applying, to the developing roller 21, a developing bias voltage by an unshown developing bias voltage source.

An intermediary transfer member unit 120 includes an intermediary transfer belt 120*e* which is an intermediary transfer member and which is supported by a plurality of rollers. In this embodiment, the intermediary transfer belt 120*e* is supported by a driving roller 120*f* and a tension roller 120*g* which are two rollers, and the tension roller 120*g* applies tension in an arrow E direction. Further, inside the intermediary transfer belt 120*e*, the primary transfer rollers 12*a*, 12*b*, 12*c* and 12*d* are provided opposed to the photosensitive drums 1*a*, 1*b*, 1*c* and 1*d*, respectively, and a transfer bias is applied to each of the primary transfer rollers 12 by an unshown bias application portion.

The toner images formed on the photosensitive drums 1 are successively primary-transferred onto the intermediary transfer belt 120*e* rotating in an arrow F direction, by applying a bias of the positive polarity to the respective primary transfer rollers 12. The toner images in a superposed state of the four color toner images are formed (carried) on the intermediary transfer belt 120*e*. The toner images formed on the intermediary transfer belt 120*e* are fed to a secondary transfer portion 15 by rotational movement of the intermediary transfer belt 120*e* in the arrow F direction.

A feeding device 13 includes a feeding tray 11 accommodating recording materials S, a feeding roller 9 for feeding the recording material S from an inside of the feeding tray 11, and a feeding roller pair 10 for feeding the fed recording material S.

The feeding tray 11 is constituted so as to be pulled out of the image forming apparatus P at the bottom in an opposite direction to a feeding direction of the recording material S. A user pulls out the feeding tray 11 and dismounts the feeding tray 11 from the image forming apparatus P, and thereafter sets the recording materials S in the feeding tray 11 and then inserts the feeding tray 11 into the image forming apparatus P again, so that supply of the recording materials S is completed.

The recording materials S accommodated in the feeding tray 11 are press-contacted to the feeding roller 9 and are separated one by one by a separation pad 20, and the separated recording material S is fed by the feeding roller pair 10.

Then, the recording material S fed from the feeding device 13 is fed by a registration roller pair 17 to the secondary transfer portion 15 which is a transfer portion and where a secondary transfer roller 16 and the intermediary transfer belt 120*e* oppose each other. The intermediary transfer belt 120*e* is supported by the driving roller 120*f* and the tension roller 120*g* which are the two rollers, of which the driving roller 120*f* opposes the secondary transfer roller 16 through the intermediary transfer belt 120*e*.

In the secondary transfer portion 15, by applying a bias of the positive polarity to the secondary transfer roller 16, the four-color toner images are collectively secondary transferred from the intermediary transfer belt 120*e* onto the recording material S fed by the registration roller pair 17.

The fixing portion 14 which is a fixing portion applies heat and pressure to an image (toner image) transferred on the recording material S and fixes the image on the recording material S. The recording material S on which the image is fixed is discharged onto a sheet discharge tray 31 by a discharging roller pair 18.

On the other hand, toner remaining on the surface of each of the photosensitive drums 1 after the toner images are primary-transferred from the photosensitive drums 1 onto the intermediary transfer belt 120*e* is removed by the associated cleaning blade 8 which is a cleaning portion. The toner removed from each photosensitive drum 1 by the cleaning blade 8 is collected in a residual toner container in the cleaner unit 5.

Further, the toner remaining on the surface (outer peripheral surface) of the intermediary transfer belt 120*e* after the toner images are secondary-transferred from the intermediary transfer belt 120*e* onto the recording material S is removed by a belt cleaning device 19. The belt cleaning device 19 is a cleaning portion for removing the toner, remaining on the intermediary transfer belt 120*e* after the secondary transfer, in contact with the intermediary transfer belt 120*e* which is the intermediary transfer belt. The toner removed from the intermediary transfer belt 120*e* by the belt cleaning device 19 passes through a residual toner feeding passage (not shown), and is collected in a residual toner collecting container (not shown).

First Embodiment

Figure 2:
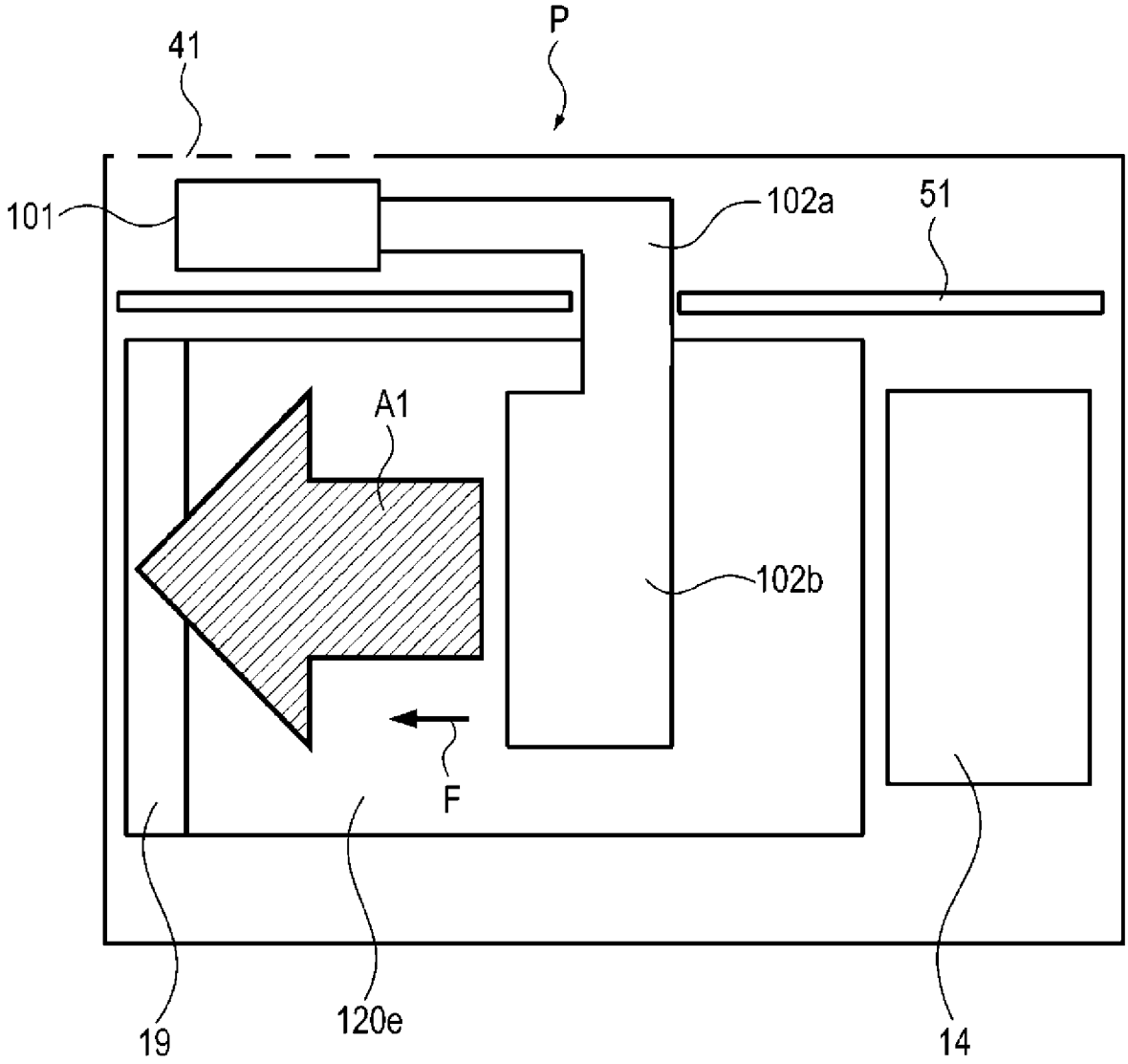
FIG. 2 is a schematic top plan view of an air flow structure in the first embodiment.

Next, by using FIGS. 1 and 2, an air blowing portion for blowing (sending) air in order to cool the intermediary transfer member unit 120 will be described. FIG. 2 is a schematic top plan view of an air flow structure by the air blowing portion in a first embodiment.

Inside the image forming apparatus P, an air blowing portion 100 for blowing the air in order to cool the intermediary transfer belt 120*e* is provided. The air blowing portion 100 is constituted by a fan 101 which is an air blowing source and an air duct 102*a* for guiding the air to an air outlet (air discharge port) 120*b*. The air blowing portion 100 is provided at a position vertically below the sheet discharge tray 31 and vertically above the intermediary transfer member unit 120, specifically the intermediary transfer belt 120*e* in the image forming apparatus P. The fan 101 is provided outside a rear side plate 51 for supporting the intermediary transfer belt 120*e* and the fixing portion 14 in the image forming apparatus P as shown in FIG. 2. Incidentally, in FIG. 2, only the rear side plate 51 for supporting the intermediary transfer belt 120*e* and the fixing portion 14 is shown. The intermediary transfer belt 120*e* and the fixing portion 14 are supported by the rear side plate 51 on one end side and by an unshown front side plate on the other end side with respect to an axial direction which is a rotation center of the photosensitive drum 1.

As seen from vertically above as shown in FIG. 2, the fan 101 is disposed at a non-overlapping position with the intermediary transfer belt 120*e*. On the other hand, the air duct 102*a* connected to the fan 101 has a structure such that the air duct 102*a* penetrates through the rear side plate 51 from an outside of the rear side plate 51 to an inside of the rear side plate 51 where the intermediary transfer belt 120*e* and the fixing portion 14 are disposed. The air outlet 102*b* of the air duct 102*a* connected to the fan 101 is provided above the intermediary transfer belt 120*e*. This air outlet 120*b* is provided between the driving roller 120*f* and the tension roller 120*g* which form an opposing surface of the intermediary transfer belt 120*e* to the photosensitive drums 1, so as to oppose the outer peripheral surface of the intermediary transfer belt 120*e* on a side opposite from the opposing surface of the intermediary transfer belt 120*e*. Incidentally, in the image forming apparatus P shown in FIG. 1, when the opposing surface of the intermediary transfer belt 120*e* to the photosensitive drums 1 is a lower (-side) outer peripheral surface, an opposing surface of the intermediary transfer belt 120*e* to the air outlet 102*b* is an upper (—side) outer peripheral surface. The air outlet 102*b* is disposed between the secondary transfer roller 16 which is a transfer portion and the belt cleaning device 19 which is a cleaning portion. Through the air outlet 102*b*, the air from the fan 101 is blown toward the outer peripheral surface of the intermediary transfer belt 120*e*.

As shown in FIG. 1, above the intermediary transfer belt 120*e*, a stay 52 which is a plate member is provided so as to oppose the (upper) outer peripheral surface. The air outlet 102*b* of the air duct 102*a* connects to an opening (not shown) of the stay 52.

The fan 101 sucks outside air through an air inlet louver (suction louver) 41 provided on the rear surface (side) of the image forming apparatus P and disposed so that a plurality of elongated thin plates are arranged in parallel with intervals. Here, the rear surface of the image forming apparatus P refers to the rear side plate 51 side shown in FIG. 1 with respect to the axial direction which is the rotation center of the photosensitive drum 1. The air from the fan 101 in which the outside air is sucked through the air inlet louver passes through an inside of the air duct 102*a* and is discharged through the air outlet 102*b* provided above the intermediary transfer belt 120*e*. The air (cooling air) blown through the air outlet 102*b*, i.e., the air by the air blowing portion 100 is sent through the opening of the stay 52 to between the stay 52 and the upper outer peripheral surface of the intermediary transfer belt 120*e* opposing the stay 52. Then, the air sent to between the stay 52 and the upper outer peripheral surface of the intermediary transfer belt 120*e* flows along the surface of the intermediary transfer belt 120*e* in a normal direction (which is the same direction as an arrow A direction) with respect to a movement direction (arrow F direction) of the intermediary transfer belt 120*e* (see FIG. 2). The air outlet 120*b* is positioned, for example, on an upstream side with respect to a phantom (virtual) line perpendicular to the upper outer peripheral surface of the intermediary transfer belt 120*e* and is disposed so that the air is blown to a portion where the upper outer peripheral surface and the phantom line cross each other. Thus, the air sent to between the stay 52 and the upper outer peripheral surface of the intermediary transfer belt 120*e* flows along the surface of the intermediary transfer belt 120*e* in a direction (arrow A1 direction) of moving away from the secondary transfer roller 16. By this, the intermediary transfer belt 120*e* and the belt cleaning device 19 are cooled.

The direction (arrow A1 direction) in which the air (cooling air) sent through the air outlet 102*b* flows is a direction of moving away from the fixing portion 14 and the feeding passage of the recording material, and therefore, this air does not flow into the fixing portion 14 and the feeding passage. Accordingly, there are no phenomena that improper fixing is caused by flowing of the air, for cooling the intermediary transfer belt 120*e*, into the fixing portion 14 and that an attitude of the recording material is influenced by flowing of the air into the recording material feeding passage. Further, the air is blown along the upper outer peripheral surface of the intermediary transfer belt 120*e*, so that the air does not have the influence on the transferred toner images existing on the lower outer peripheral surface of the intermediary transfer belt 120*e* which is an opposing surface to the photosensitive drums 1.

By providing the fan 101 on the rear surface (side) of the image forming apparatus P, influence of heat at a periphery can be suppressed, so that the fan 101 can be provided in the neighborhood of the air outlet louver 41. The outside air sucked by the fan 101 is guided to the air outlet 102*b* by the air duct 102*a*, so that cooling efficiency can be enhanced. Further, the fan 101 is provided on the rear surface of the image forming apparatus P, the air outlet louver 41 can also be provided on the rear surface of the image forming apparatus P, so that it is possible to avoid that the air outlet louver 41 comes within sight of a user during normal use. Further, the fan 101 is disposed on the rear surface of the image forming apparatus P, so that it is also possible to except an effect of suppressing a driving noise of the fan 101 leaked to an outside of the image forming apparatus P through the air outlet louver 41.

Second Embodiment

Figure 3:
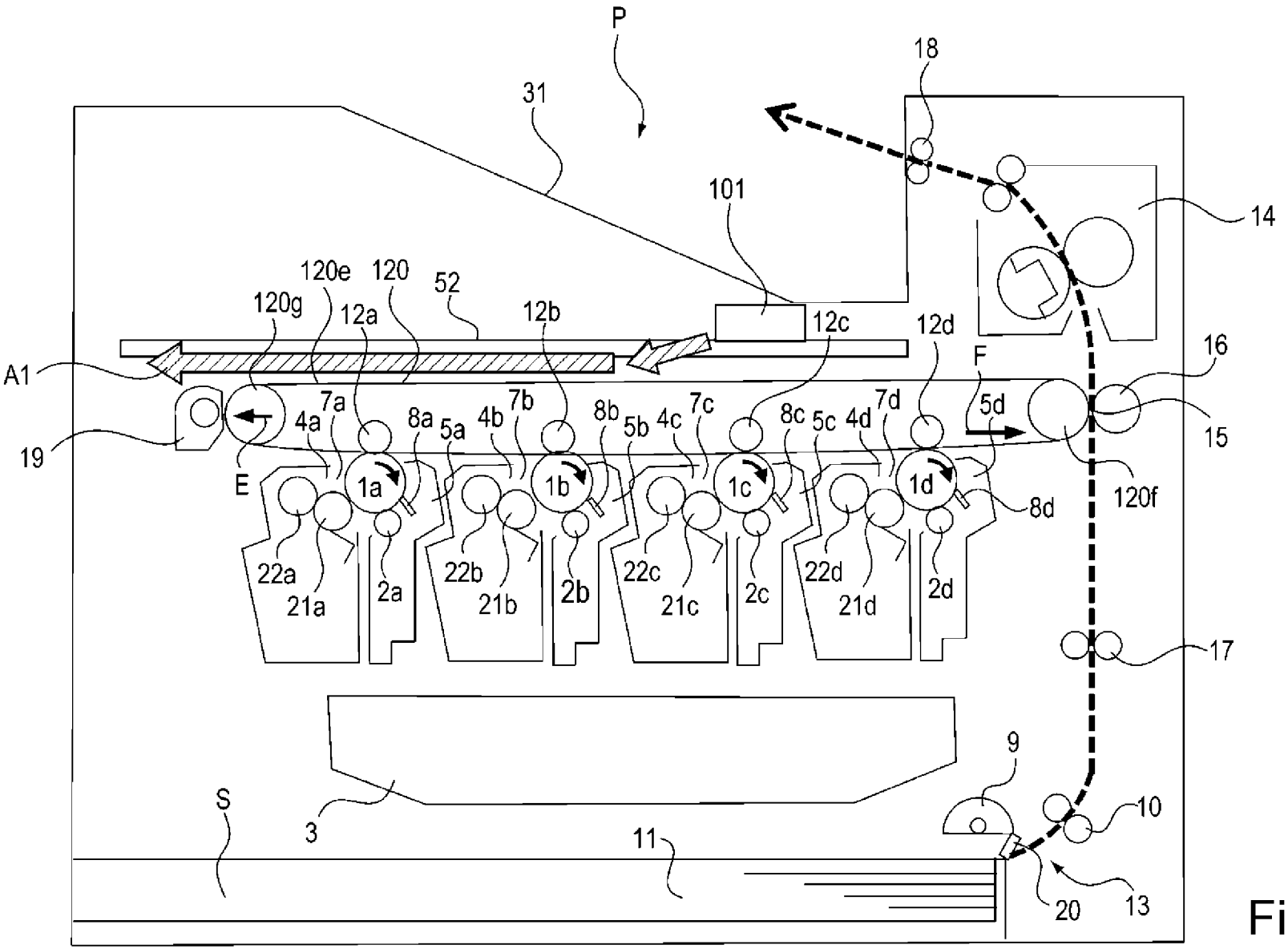
FIG. 3 is a principal sectional view of an image forming apparatus according to a second embodiment.
Figure 4:
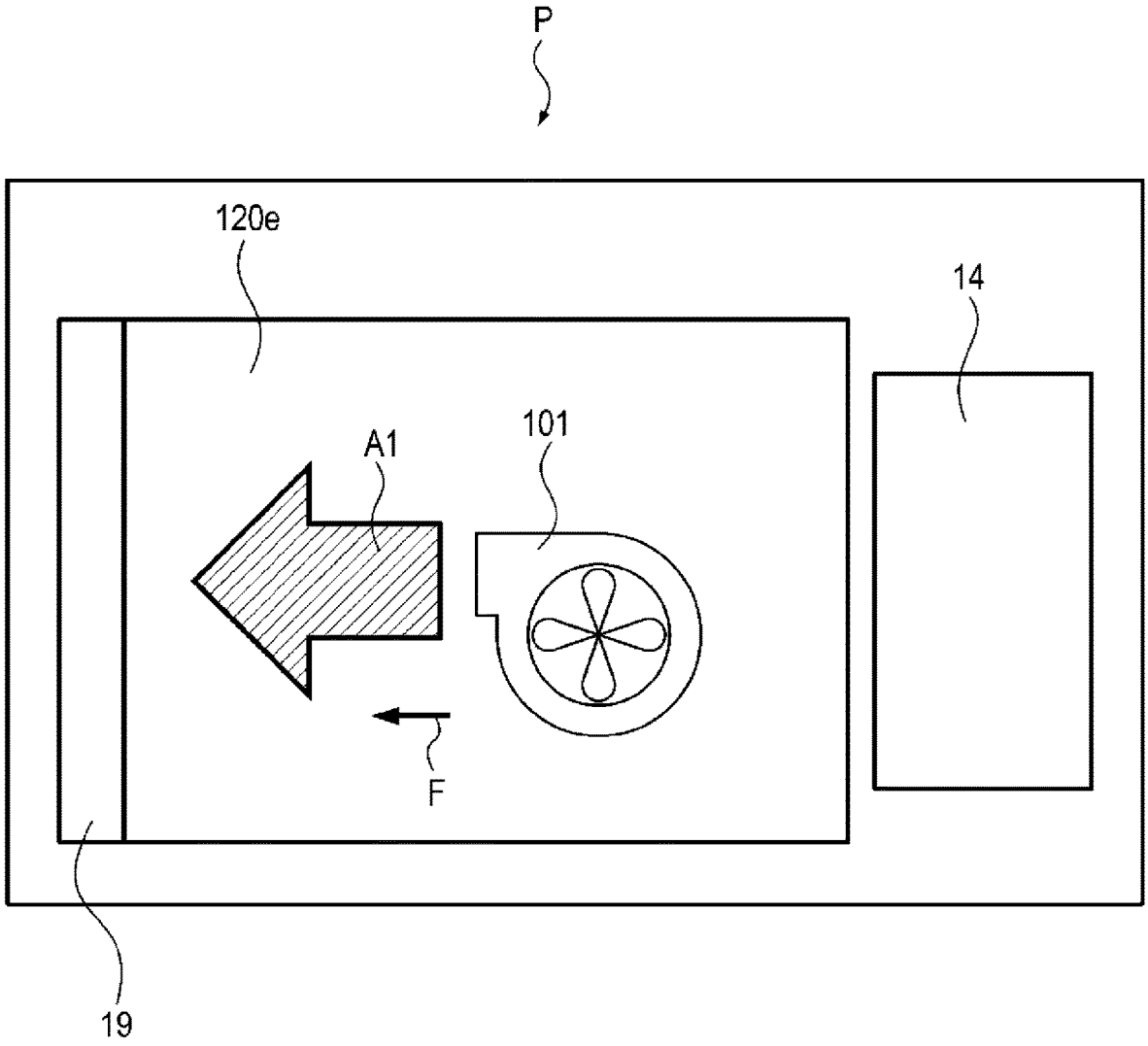
FIG. 4 is a schematic top plan view of an air flow structure in the second embodiment.

Next, by using FIGS. 3 and 4, an image forming apparatus according to a second embodiment will be described. Incidentally, portions overlapping with those of the above-described first embodiment will be omitted from description. FIG. 3 is a principal sectional view showing a general structure of an image forming apparatus P in the second embodiment. FIG. 4 is a schematic top plan view of an air flow structure by an air blowing portion in the second embodiment.

The air blowing portion 100 provided inside the image forming apparatus P is constituted by a fan 101 which is an air blowing source.

As seen from vertically above as shown in FIG. 2, the fan 101 is disposed vertically above at an overlapping position with the intermediary transfer belt 120*e*. The fan 101 is provided between the driving roller 120*f* and the tension roller 120*g* which form an opposing surface of the intermediary transfer belt 120*e* to the photosensitive drums 1, so as to oppose the outer peripheral surface of the intermediary transfer belt 120*e* on a side opposite from the opposing surface of the intermediary transfer belt 120*e*. Incidentally, similarly as in the above-described embodiment, in the image forming apparatus P shown in FIG. 3, when the opposing surface of the intermediary transfer belt 120*e* to the photosensitive drums 1 is a lower (—side) outer peripheral surface, an opposing surface of the intermediary transfer belt 120*e* to the air outlet 102*b* is an upper (—side) outer peripheral surface. The fan 101 is disposed between the secondary transfer roller 16 which is a transfer portion and the belt cleaning device 19 which is a cleaning portion. From the fan 101 provided above the intermediary transfer belt 120*e*, the air is blown toward the outer peripheral surface of the intermediary transfer belt 120*e*.

As shown in FIG. 3, above the intermediary transfer belt 120*e*, a stay 52 which is a plate member is provided so as to oppose the (upper) outer peripheral surface. The fan 101 connects to an opening (not shown) of the stay 52.

Accordingly, the air (cooling air) blown through the air outlet 102*b*, i.e., the air by the air blowing portion 100 is sent through the opening of the stay 52 to between the stay 52 and the upper outer peripheral surface of the intermediary transfer belt 120*e* opposing the stay 52. Then, the air sent to between the stay 52 and the upper outer peripheral surface of the intermediary transfer belt 120*e* flows along the surface of the intermediary transfer belt 120*e* in a normal direction (which is the same direction as an arrow A direction) with respect to a movement direction (arrow F direction) of the intermediary transfer belt 120*e* (see FIG. 1). In addition, the air blown from the fan 101 and sent to between the stay 52 and the upper outer peripheral surface of the intermediary transfer belt 120*e* flows along the surface of the intermediary transfer belt 120*e* in a direction (arrow A1 direction) of moving away from the secondary transfer roller 16. By this, the intermediary transfer belt 120*e* and the belt cleaning device 19 are cooled.

According to this embodiment, it is possible to obtain an effect similar to the effect of the above-described embodiment. In addition, the air duct is not needed, and by minimizing the structure of the air blowing portion, the influence on a size of the image forming apparatus P can be suppressed.

Third Embodiment

Figure 5:
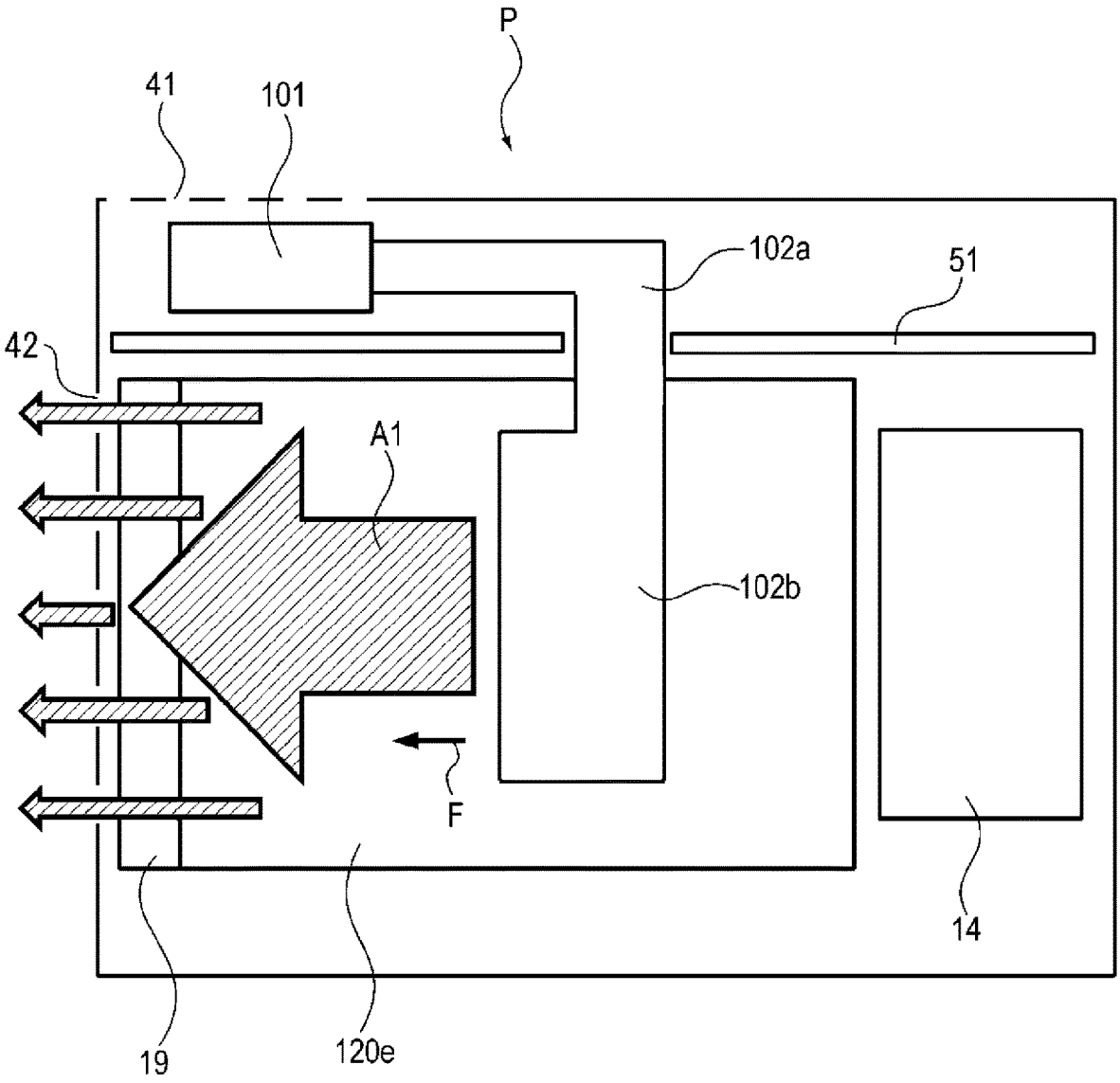
FIG. 5 is a schematic top plan view of an air flow structure in a third embodiment.

Next, by using FIG. 5, an image forming apparatus according to a third embodiment will be described. Incidentally, portions overlapping with those of the first embodiment described above will be omitted from description. FIG. 5 is a schematic top plan view of an air flow structure by an air blowing source in the third embodiment.

As shown in FIG. 5, the image forming apparatus P is provided with an air outlet louver 42, for discharging the air to the outside of the image forming apparatus P, including a plurality of elongated thin plates arranged in parallel with intervals and provided on a side surface of the image forming apparatus P on a downstream side of a direction (arrow Al direction) in which the air flows along the upper outer peripheral surface of the intermediary transfer belt 120*e*. By this, the air sent in a direction moving away from the fixing portion 14 along the outer peripheral surface of the intermediary transfer belt 120*e* cools the intermediary transfer belt 120*e* and the belt cleaning device 19 and is discharged to the outside of the image forming apparatus P through the air outlet louver 42 on the downstream side thereof.

For this reason, after the intermediary transfer belt 120*e* and the belt cleaning device 19 which are objects to be subjected to air blowing are cooled, the air is immediately discharged to the outside of the image forming apparatus P, so that it is possible to prevent the air from flowing into an unintended portion.

Fourth Embodiment

Figure 6:
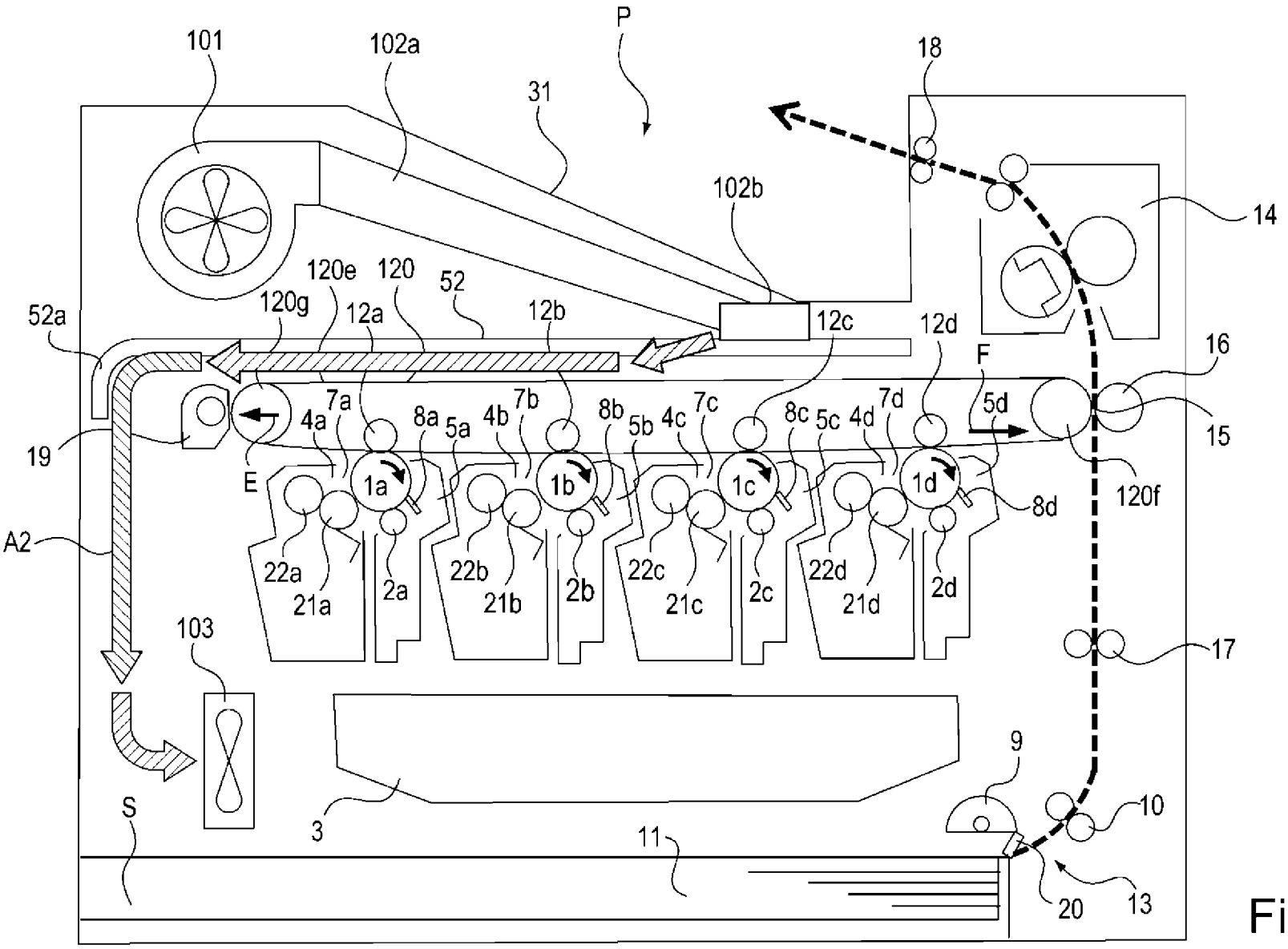
FIG. 6 is a principal sectional view of an image forming apparatus according to a fourth embodiment.

Next, by using FIG. 6, an image forming apparatus according to a fourth embodiment will be described. Incidentally, portions overlapping with those of the first embodiment described above will be omitted from description. FIG. 6 is a principal sectional view showing a general structure of an image forming apparatus P in the fourth embodiment.

As shown in FIG. 6, the image forming apparatus P in the fourth embodiment is provided with a second fan 103, which is a second air blowing portion, below the first fan 101. Further, in this embodiment, the stay 52 which is the plate member provided opposed to the upper outer peripheral surface of the intermediary transfer belt 120*e* is provided with a curved surface 52*a* which is a guiding portion for guiding downward the air flowing along the outer peripheral surface of the intermediary transfer belt 120*e*. The air sent from the fan 101 toward the intermediary transfer belt 120*e* flows in the arrow A1 direction along the outer peripheral surface of the intermediary transfer belt 120*e* and is guided in an arrow A2 direction by the curved surface 52*a* of the stay 52 on a downstream side thereof, and then is collected by the second fan 103 disposed below the first fan 101.

For this reason, after the intermediary transfer belt 120*e* and the belt cleaning device 19 which are objects to be subjected to air blowing are cooled, the air is collected by the second fan 103, so that it is possible to prevent the air from flowing into an unintended portion. Further, the second fan 103 blows the air to an unshown voltage source, so that it is also possible to enhance suction efficiency of the second fan 103 by re-use of the air (wind).

Other Embodiments

In the above-described embodiments, the image forming apparatus including the cleaning portion (belt cleaning device 19) for removing the toner after the transfer in contact with the intermediary transfer member was described as an example, but the present invention is not limited thereto. The present invention is also effective even in an image forming apparatus provided with no cleaning portion for cleaning the intermediary transfer belt. In this case, the air blown from the air blowing portion toward the intermediary transfer member is sent as follows. That is, of a plurality of rollers stretching the intermediary transfer member, between two rollers forming an opposing surface of the intermediary transfer belt to the photosensitive member, the air is sent toward the outer peripheral surface of the intermediary transfer member on a side opposite from the opposing surface by the air blowing portion. Further, by the air blowing portion, the air is sent in a direction of moving away from the roller, of the two rollers, opposing the transfer portion and in the movement direction of the intermediary transfer member. By this, even in the image forming apparatus provided with no cleaning portion for cleaning the intermediary transfer member, an effect similar to the effects of the above-described embodiments can be achieved.

Further, in the above-described embodiments, as the process cartridge mountable in and dismountable from the image forming apparatus, the process cartridge integrally including the photosensitive member and, as the process means actable on the photosensitive member, the charging portion, the developing portion and the cleaning portion was described as an example. However, the present invention is not limited thereto. A process cartridge integrally including, in addition to the photosensitive member, any one of the charging portion, the developing portion and the cleaning portion may also be employed.

Further, in the above-described embodiments, as the image forming apparatus, the printer was described as an example, but the present invention is not limited thereto. For example, the image forming apparatus may also be in the form of other image forming apparatuses such as a copying machine, a facsimile machine and a multi-function machine having a combination of functions of these machines. By applying the present invention to these image forming apparatuses, similar effects can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-074799 filed on Apr. 10, 2019, which is hereby incorporated by reference herein in its entirety.

What is claimed is:

1. An image forming apparatus comprising:

a photosensitive member;

an intermediary transfer member which is supported by a plurality of rollers and onto which a toner image formed on said photosensitive member is transferred, said intermediate transfer member being in contact with said photosensitive member;

a transfer portion configured to transfer the toner image from said intermediary transfer member onto a recording material in contact with said intermediary transfer member;

a cleaning portion in contact with said intermediary transfer member and configured to remove toner remaining from said intermediary transfer member after the transfer onto the recording material; and an air blowing portion configured to blow air, wherein, in a moving direction of said intermediary transfer member, an outer peripheral surface of said intermediary transfer member moves through an area located from a downstream side of a first portion in contact with said transfer portion to an upstream side of a second portion in contact with said cleaning portion, wherein said air blowing portion blows the air toward the area, and the air flows in the moving direction of said intermediary transfer member away from said transfer portion.

2. An image forming apparatus according to claim 1, further comprising a fixing portion configured to fix the toner image, transferred on the recording material, on the recording material by heating the toner image, wherein said air blowing portion blows the air in the moving direction of said intermediary transfer member away from said fixing portion.

3. An image forming apparatus according to claim 1, wherein with respect to a vertical direction, said intermediary transfer member is provided on said photosensitive member and said air blowing portion is provided above said intermediary transfer member.

4. An image forming apparatus according to claim 1, further comprising a plate member opposing said intermediary transfer member and above said intermediary transfer member with respect to a vertical direction, wherein said air blowing portion blows the air between said plate member and the outer peripheral surface of said intermediary transfer member opposing said plate member.

5. An image forming apparatus according to claim 1, wherein said air blowing portion includes an air blowing source provided above said intermediary transfer member, and wherein said air blowing portion blows the air from said air blowing source toward the outer peripheral surface of said intermediary transfer member.

6. An image forming apparatus according to claim 5, wherein said air blowing source is disposed between said transfer portion and said cleaning portion.

7. An image forming apparatus according to claim 1, wherein said air blowing portion includes an air blowing source and an air duct connected to said air blowing source and configured to guide the air to an air outlet, and wherein said air outlet of said air duct connected to said air blowing source is provided above said intermediary transfer member, and said air blowing portion blows the air from said air blowing source toward the outer peripheral surface of said intermediary transfer member.

8. An image forming apparatus according to claim 7, wherein said air outlet is provided between said transfer portion and said cleaning portion.

9. An image forming apparatus according to claim 7, wherein said air blowing source is provided on a rear side of said image forming apparatus, and an intake air louver is provided on the rear side of said image forming apparatus.

10. An image forming apparatus according to claim 1, further comprising an air discharging louver configured to discharge the air, blown from said air blowing portion, to an outside of said image forming apparatus, wherein said air discharging louver is provided on a downstream side of an air flowing direction along the outer peripheral surface of said intermediary transfer member and on a side surface of said image forming apparatus.

11. An image forming apparatus according to claim 1, further comprising a second air blowing portion provided below said air blowing portion, wherein said second air blowing portion collects the air blown from said air blowing portion.

* * * * *